US005778613A

United States Patent [19]

Thomson

[11] Patent Number: 5,778,613

[45] Date of Patent: Jul. 14, 1998

[54] CANOPY STRUCTURES

[75] Inventor: Darryl Alexander Thomson, Camberwell, Australia

[73] Assignee: Thomson Tensile Pty Ltd., Malvern, Australia

[21] Appl. No.: 353,817

[22] Filed: Dec. 9, 1994

[30] Foreign Application Priority Data

Dec. 9, 1993 [AU] Australia ..... PM2871

[51] Int. Cl.[6] ..... E04H 15/18; E04H 15/54; E04H 15/64

[52] U.S. Cl. ..... 52/222; 52/63; 52/273; 135/115; 135/119; 135/908; 160/328

[58] Field of Search ..... 52/63, 222, 273; 135/908, 907, 119, 117, 115; 160/327, 328, 354, 368.1

[56] References Cited

U.S. PATENT DOCUMENTS

| | | | |
|---|---|---|---|
| 3,820,840 | 6/1974 | Forsberg . | |
| 4,162,100 | 7/1979 | Muscillo . | |
| 4,677,999 | 7/1987 | Cannon et al. | 135/907 X |
| 5,146,722 | 9/1992 | Stafford | 52/63 X |
| 5,197,239 | 3/1993 | Glynn et al. | 52/63 |

FOREIGN PATENT DOCUMENTS

| | | |
|---|---|---|
| 3297/26 | 8/1926 | Australia . |
| 40 495/78 | 4/1980 | Australia . |
| 26310/88 | 11/1988 | Australia . |
| PCT/AU82/00186 | 5/1983 | WIPO . |

*Primary Examiner*—Christopher Todd Kent
*Attorney, Agent, or Firm*—Cooley Godward LLP; Craig P. Opperman, Esq.

[57] ABSTRACT

A canopy structure 50 a plurality of support posts 11, 12, 13, 14 arranged substantially in the form of an array 51, and a plurality of panels 10 mounted on the support posts to form a canopy cover 50. Each panel 10 is a rectangular sheet of flexible material 16 and a plurality of substantially inextensible support straps 17, 18, 19, 20 fixed to the sheet 16. A support strap extends along each side of the sheet 16. Each end of each support strap is mounted to a support post and an intermediate point is attached to the support strap of an adjacent panel. The support straps generally have a twin catenary configuration which draws fabric from the inner area of the panel towards the edge thereof. The panels are attached to the support posts and to each other by loops of webbing 30, connecting rings 31, and shackles. The loops of webbing 30 are typically reinforced to reduce the likelihood of failure thereof. A canopy panel 10 for use in the canopy structure described above is also included.

19 Claims, 5 Drawing Sheets

CANOPY STRUCTURES

This invention relates generally to canopy structures. More specifically this invention relates to canopy structures of the type in which an array of support posts support a canopy cover formed from a plurality of discrete cover panels. Each panel is mounted on a sub-array of four posts and covers the space defined therebetween. This invention will be described with reference to a canopy structure whose primary function is to provide shade, but it is to be appreciated that it is capable of broader sheltering applications. For example, it may also provide shelter against wind, rain and hail.

A particular known canopy structure comprises an array of support posts having an array of cover panels mounted thereon in the manner described above. A cover panel 1 for such a canopy structure is shown in FIG. 1. The cover panel comprises a retangular sheet of stretch fabric 2 having a series of substantially inextensible support straps 3 extending along each side of the panel, at or adjacent the edge 4 thereof. The ends 5, 6 of each strap 3 are positioned in the corners of the panel and an intermediate or middle portion 7 thereof is displaced inwardly in from the edge of the panel as shown in the drawing. Tensioning of the straps 3 enables the panel 1 to be drawn tautly across the space between adjacent posts. During tensioning of the straps, the curved configuration of the straps 3 is straightened out to some extent, drawing fabric from the middle area of the panels and reducing sagging deflection of the panel in this area.

Each end of each strap is attached to the adjacent post by means of an attachment element. The attachment element typically includes a turnbuckle or the like which can be reeled in to tension the straps.

Because the degree of sagging deflection of the panel has to be maintained within certain limits, the individual panels cannot be made large enough for many applications.

There is therefore a need for an improved canopy structure having improved sagging deflection characteristics thereby enabling each panel to cover a larger area than is the case with existing structures. Further, there is a need for a structure having improved means for tensioning the cover panels and having the ability to withstand higher levels of wind loading than existing structures.

It is an object of this invention to provide an improved canopy panel and canopy structure which at least partly overcome the drawbacks described above.

According to a first aspect of this invention there is provided a canopy panel for mounting on a plurality of support posts, including:

a sheet of flexible material;

a plurality of substantially inextensible support straps fixed to the sheet, one said strap extending substantially along each side of the sheet, each strap having means at each end thereof for mounting the panel to a support post, and also means intermediate the strap ends for attaching at least one intermediate point on the support strap to a like point on the adjacent support strap of an adjacent panel.

Preferably the support strap defines a catenary configuration between adjacent points of attachment of the strap to either a support post or adjacent strap.

Preferably the ends of each catenary configuration are substantially adjacent the edge of the sheet and the remainder of the catenary configuration is positioned inwardly of the edge of the sheet.

Preferably the means intermediate the strap ends has only one intermediate point on the strap for attachment thereof to a like point on the adjacent support strap.

Preferably each said support strap includes two strap elements arranged substantially end-to-end, and preferably said intermediate point of attachment on the strap is positioned in between said strap elements.

Preferably said means for attaching said intermediate point on said strap to the adjacent strap comprises at least one attachment element. In a preferred form, there are two attachment elements, one on each of the two strap elements, the attachment elements facilitating coupling of the strap elements to each other as well as attachment to the adjacent support strap.

Preferably the means for mounting the panel to the support posts comprise further attachment elements at each end of the support strap. In a most preferred form both the one and further attachment elements comprise a loop of strap material.

Preferably the loop of strap material incudes a short length of bent rope for shaping the loop, and preferably the rope is enclosed in a sheath of material of low frictional resistance for reducing wear of the loop due to a connecting ring or the like which happens to be passed therethrough.

In a preferred embodiment, the canopy panel has a substantially rectangular configuration for mounting on four support posts, and each strap is formed of webbing material and sheet formed of knitted stretch fabric. Typically each strap is sewn to the sheet substantially along the full length of the strap by means of a double sinusoidal stitch.

According to a second aspect of this invention there is provided a canopy structure including:

a plurality of support posts arranged substantially in the form of an array;

a plurality of panels mounted on the support posts to form a canopy cover, each panel comprising a sheet of flexible material and a plurality of substantially inextensible support straps fixed to the sheet, a said strap extending substantially along each side of the sheet with the ends of the strap mounted onto a said post, and at least one support strap of each panel having at least one point intermediate the ends thereof at which the strap is attached to a like point on the strap of an adjacent panel.

Preferably each support strap of each panel defines a catenary configuration between adjacent points of attachment of the strap to either a support post or adjacent panel.

Preferably the ends of each catenary configuration are substantially adjacent the edge of the sheet and the remainder thereof is positioned inward of the edge of the sheet.

Preferably the at least one support strap has only one point intermediate the ends thereof at which the strap is attached to the strap of an adjacent panel, and preferably the point being located substantially midway along the length thereof.

Preferably the at least one support strap comprises two strap elements arranged substantially end-to-end, and the intermediate point of attachment to an adjacent strap is located between the strap elements.

Preferably the canopy structure includes at least two attachment elements at said intermediate point of attachment on said support straps, one on each of the support strap elements, the attachment elements facilitating attachment of the support straps to the straps of an adjacent panel and also facilitating coupling of the two strap elements to each other.

Preferably the canopy structure includes further attachment elements at each end of each support strap facilitating attachment of the support straps to the support posts. In a preferred form the one and further attachment elements each comprise a loop of strap material.

Preferably each loop includes a short length of bent rope for shaping the loop, the rope being enclosed in a sheath of material of low frictional resistance for reducing wear of the loop due to a connecting ring or the like which happens to be passed therethrough.

Preferably each canopy panel has a substantially rectangular configuration and is mounted on four support posts, and all canopy panels except those forming part of the peripheral edge of the canopy structure have intermediate points of attachment on all four of the straps thereof.

Preferably the canopy structure includes connecting rings passed through the loops at each end of each strap and passed through anchors on the support posts, to anchor each end of each support strap to the support posts. The connecting rings may be delta connecting rings or shackles, such as D-shackles and the term connecting ring is to be construed to include within its scope these components.

Preferably the canopy structure includes further connecting rings attaching the loops of each intermediate point of attachment on the support straps to the intermediate point of attachment on adjacent support straps. As described above, the connecting rings may include delta connecting rings, or shackles such as D-shackles.

Preferably the contiguous edges of adjacent panels are attached to each other along substantially the entire length thereof so that the canopy cover is continuous. Further, in a most preferred form, the support straps are mounted on the underside of the sheet of flexible material so that it is to some extent shielded by the sheet from ultra-violet radiation from the sun.

Preferably the canopy structure includes canopy support means linking substantially all the support posts together, supporting said support posts independently of the canopy panels, and also tensioning the canopy structure including canopy panels.

Preferably the support means comprises a network of flexible elongate elements under tensile loading. Typically the flexible elongate elements are affixed to the posts spaced beneath the canopy cover.

In use the elongate elements are tensioned, to pull the posts apart from each other and tension the canopy structure. Tensioning of the elongate elements simultaneously tensions the canopy panels which are mounted on the posts so that the panels are drawn tautly across the support posts and sagging deflection thereof is maintained within acceptable limits.

Preferably the elongate elements are wires or cables. Advantageously each of the cables extends parallel either to the length or width of the array of posts.

Preferably the tensioning means also includes guys mounted on one or more of the posts located on the periphery of the array of posts. Advantageously each of the posts on the periphery of the array has a guy mounted thereto.

Thus the tensioning means is essentially separate and distinct from the panels forming the canopy cover. Tensioning of the panels therefore occurs automatically as a consequence of tensioning of the support frame.

Typically each support post has at least two said cables converging thereon. Advantageously the cables extend perpendicularly to each other. Preferably one such cable is positively attached to the post while the other cable may be either attached to the post or simply passed through an opening in the post without a positive attachment to the post.

Preferably the interconnecting means includes cleats for effecting positive attachment of the cables to the posts and also for tensioning the frame.

In a most preferred form, the post is rectangular having cleats on each face thereof and having a passage formed therethrough between two opposed faces.

A canopy panel and structure according to the invention may take any one of a variety of forms. It will be convenient however to hereinafter describe the invention in greater detail by reference to several example embodiments as shown in the accompanying drawings. The particularity of these drawings is not to be understood as superseding the generality of the preceding description. In the drawings.

Figure 2:
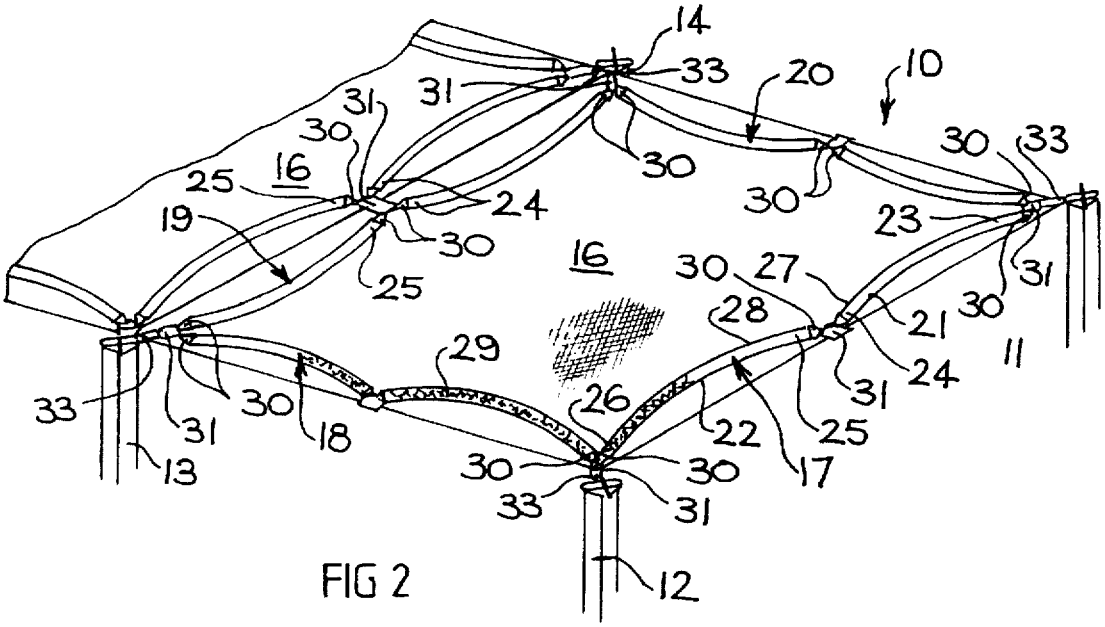
FIG. 2 is a perspective view of two adjacent canopy panels forming part of a canopy structure.

Referring initially to FIG. 2, a single panel 10 of a canopy structure is shown supported by four posts 11, 12, 13, 14. The posts 11, 12, 13, 14 are located in the corners of the panel 10 and are attached thereto.

The panel 10 comprises a sheet of stretch fabric 16 having support straps numbered 17, 18, 19, and 20 fixed thereto. The support straps 17, 18, 19, 20 extend along each side of the sheet 16 at or adjacent the edge thereof.

Each strap 17, 18, 19, 20 comprises two identical strap elements 21, 22 arranged end-to-end along the side of the panel 10. Each strap element 21, 22 defines a catenary or crescent configuration with the ends 23, 24, 25, 26 of the strap element being located on the edge of the sheet 16, and the intermediate portions 27, 28 thereof spaced inwardly in from the edge of the sheet 16. The inner ends 24, 25 of the two strap elements 21, 22 are attached to each other and the inner ends of the adjacent strap element of the adjacent panel 10. The outer ends 23, 26 of the two strap elements 21, 22 are attached to their respective adjacent posts 11 and 12. This arrangement which is particularly important in the performance of the invention is illustrated clearly in FIG. 2.

Each strap 17, 18, 19, and 20 is of substantially inextensible webbing material and is sewn to the sheet 16 substantially along the full length of the strap. A double sinusoidal stitch 29 may be used to sew the webbing to the sheet 16 to give a particularly strong and durable fixing of webbing to the sheet 16.

Each end of each strap element 21, 22 has attachment elements in the form of loops of webbing 30. The inner ends 24, 25 of the strap elements 21, 22 are attached to each other by passing a connecting ring or D-shackle 31 through the loops 30. The shackle 31 is also passed through the loops at the ends 24, 25 of the strap of the adjacent panel. The outer ends 23, 26 of the strap elements 21, 22 which converge on the same post, say post 13, are attached to the post 13 by passing a D-shackle or connecting ring 31 through the loops 30 and through a panel anchor 33 on the post 13. The panel anchor 33 is described in more detail below.

Many other arrangements could be adopted for attaching the two strap elements to each other and the adjacent support strap and attaching the ends of the straps to the post. For example, a connecting ring 31 might be passed through the webbing loops 30 and then a D-shackle or the like passed through the ring 31 to anchor the straps to the panel anchor 33. While this construction has not been illustrated, shackles are well known in the art and the general arrangement of these components would be well understood by a person skilled in the art.

Figure 3:
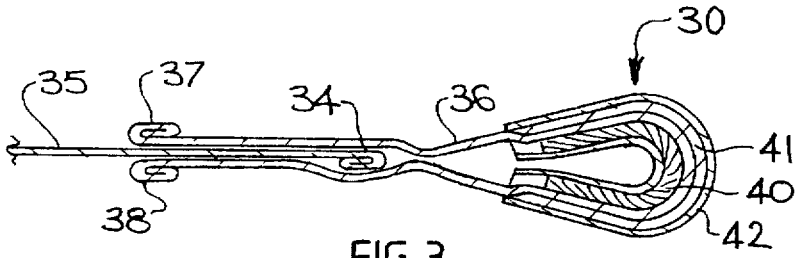
FIG. 3 is a sectional front view of an end region of a support strap of the panel shown in FIG. 2.
Figure 4:
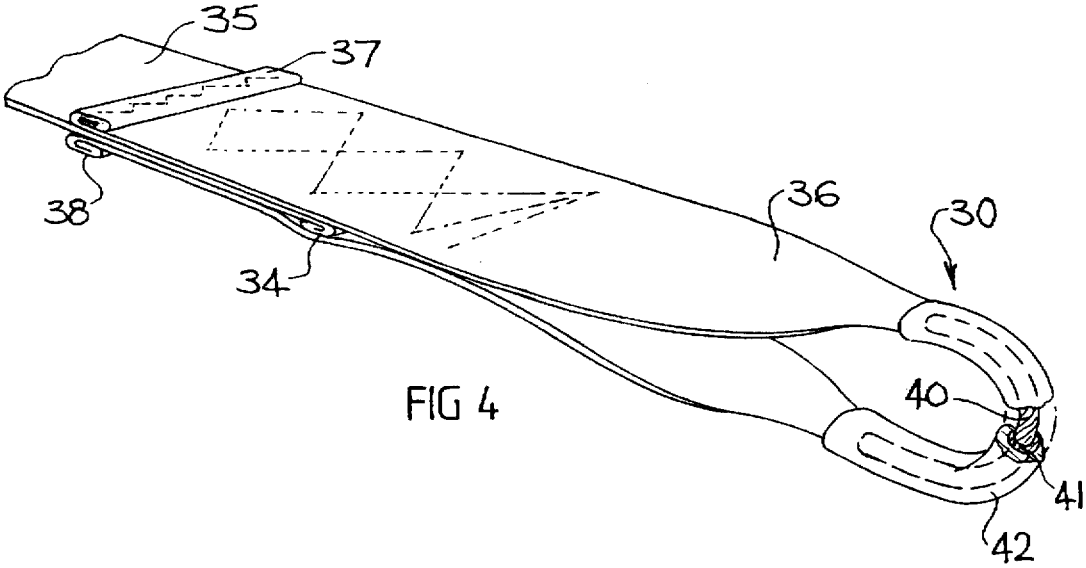
FIG. 4 is a perspective view of the end region of support strap shown in FIG. 3.

FIGS. 3 and 4 illustrate the construction of the webbing loops indicated generally by numeral 30. The end 34 of the webbing 35 forming the body of the strap element 21 or 22 is folded over and stitched. A further piece of webbing 36 is looped around the folded end 34 of the webbing 35. The free ends 37, 38 of the webbing 36 are folded over and stitched in the same manner as the end 34 of the webbing 35. End regions of the webbing 36, adjacent the ends 37 and 38 thereof are sewn to the webbing 35. The loop 30 has additional structural components including a rope 40, a yet further piece of webbing 41 and a leather sleeve 42, for forming it into an appropriate shape and to give it sufficient strength and wear resistance. The rope 40 is curled within the webbing 36 to form the loop 30 into a rounded configuration. The webbing 41 surrounds and encloses the webbing 36 and the leather sleeve 42 surrounds the webbing 41. Leather provides a convenient wear surface with low frictional resistance for rubbing against the connection ring or shackle 31.

In one example application, the stretch fabric 16 is formed from a knitted monofilament polyester shade cloth made by Gale Australia Pty Ltd and the support straps are formed from WEBCO webbing which is commonly used for automotive seat belts. The webbing 35 is an RD 143 WEBCO webbing having a breaking strain of 45 kN. The webbings 36 and 41 are made from ST 35 WEBCO webbing having a breaking strain of 25 kN. Each of these webbings typically has a width of about 50 mm.

Figure 5:
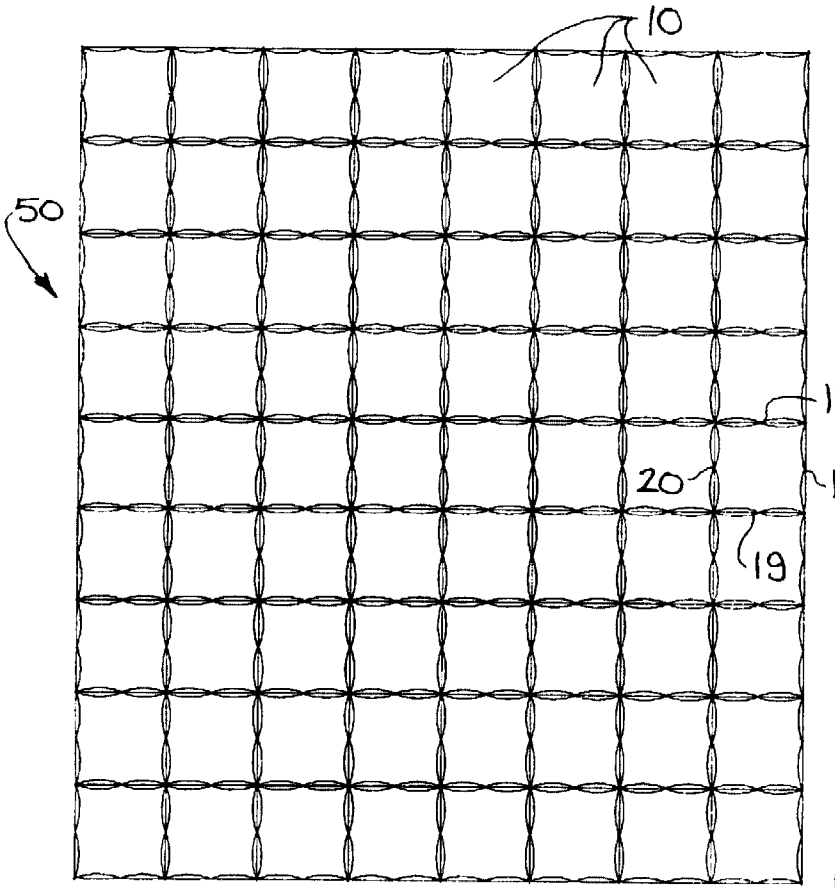
FIG. 5 is a schematic plan view of a canopy structure in accordance with the invention, with some details omitted for clarity.
Figure 14:
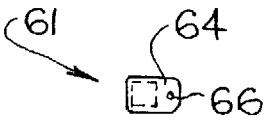
FIG. 14 is a plan view of the post of FIG. 13.
Figure 15:
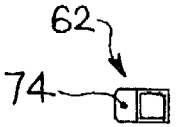
FIG. 15 is a sectional plan view through section XIV—XIV of FIG. 14.
Figure 13:
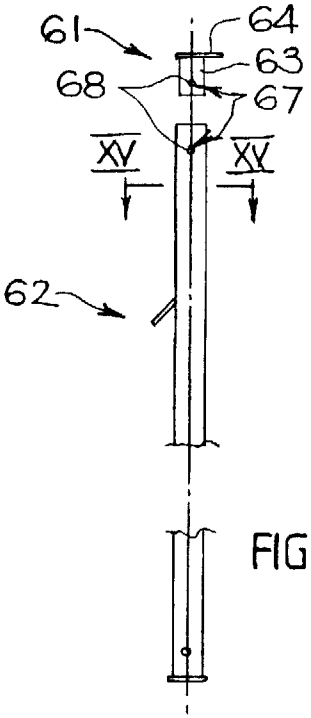
FIG. 13 is an exploded front view of another post of the canopy structure illustrated in FIGS. 5 and 6.
Figure 12:
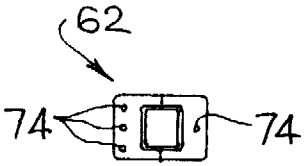
FIG. 12 is a section plan view through section XII—XII in FIG. 11.
Figure 11:
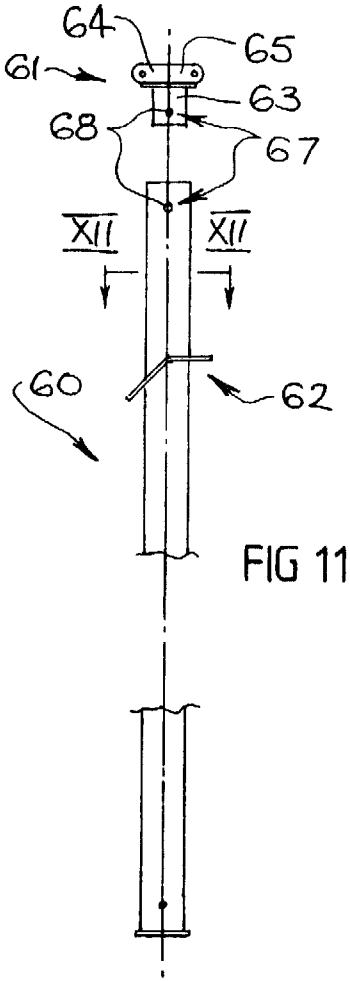
FIG. 11 is an exploded front view of another post of the canopy structure illustrated in FIGS. 5 and 6.
Figure 19:
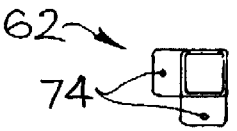
FIG. 19 is a sectional plan view through section XIX—XIX of FIG. 18.

FIG. 5 shows a complete canopy cover 50 comprising an array of panels 10 as shown in FIG. 2.

The support and tensioning of the panels 10 by means of the support straps and posts while providing structural strength does not create continuous canopy cover providing shelter from the elements. This is achieved by joining the edges of the sheets 16 to each other. Each side of each sheet 16 having an adjacent sheet alongside is joined to that sheet along the full length thereof. Typically the sheets are sewn together but it is to be appreciated that other means of joining the edges of the sheets could equally be used.

The joining of the edges of the sheets does not perform any load bearing function. The load is borne by the straps of webbing. However, the provision of continuous canopy cover is important if the structure is to be effective at providing shade and shelter from the elements such as rain.

Figure 6:
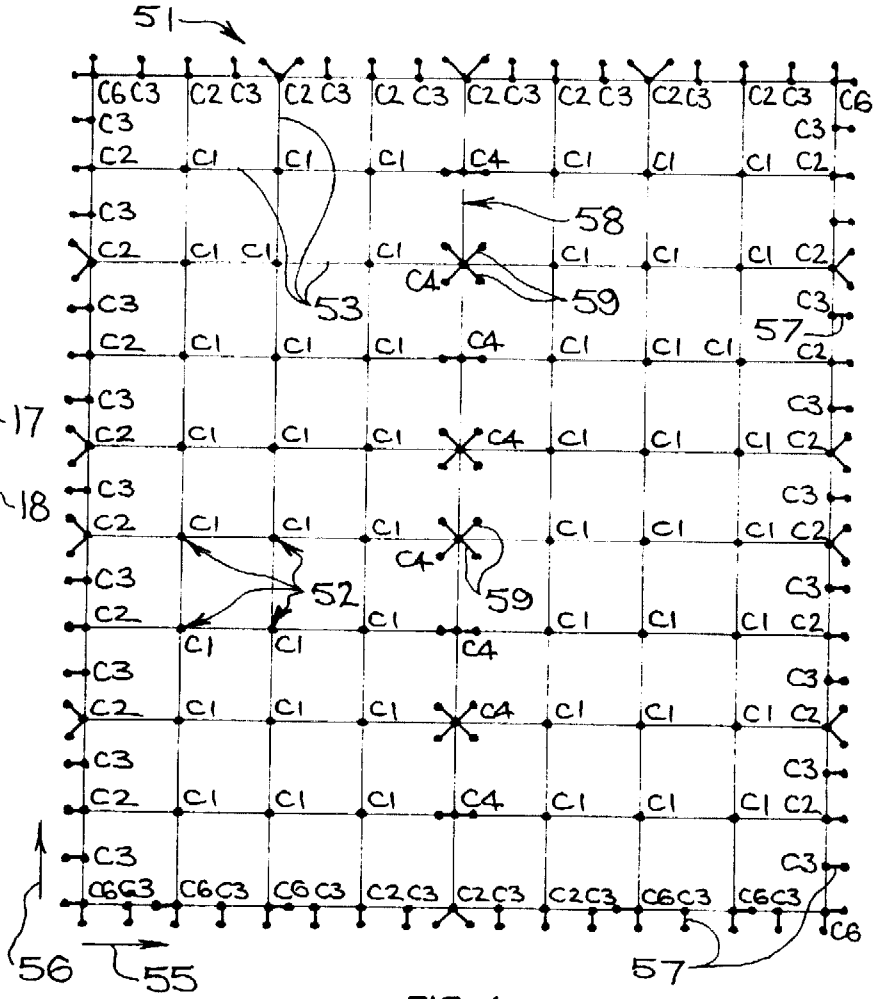
FIG. 6 is a schematic plan view of the array of support posts for the canopy structure of FIG. 5.

FIG. 6 shows the arrangement of one particular array of support posts 51 for a canopy structure. The posts 11, 12, 13 and 14 of FIG. 2 form a discrete sub-array 52 of the greater array of posts 51. Interconnecting means in the form of a plurality of wires or cables 53 under tension interconnect all the posts of the array 51. One set of cables 53 extends in one direction 55 and another set of cables extends in another direction 56 perpendicular thereto.

Each post has at least two cable strands projecting outwardly away therefrom. Each of the internal posts has four cable strands extending outwardly away therefrom. At least two of the four converging cable strands are positively attached to the post by means of a cleat which is described in more detail below. The remaining two cable strands may either be positively attached to the post by means of a cleat or else simply passed through a passage in the post. Effectively the two cable strands in the latter instance form part of the same cable body which is simply passed through a passage in the post without positive attachment thereto.

Each of the posts positioned on the periphery of the array 51 has a guy 57 extending from the post to the support surface. This assists in tensioning the frame 51 in much the same way as a guy can be used to tension a tent or marquee. Further a row of internal posts 58, parallel to direction 56, has guys 59 extending away from each post thereof.

In the embodiment illustrated in FIGS. 5 and 6 above, each panel 10 covers an area of about 208 sq. metres.

Figure 1:
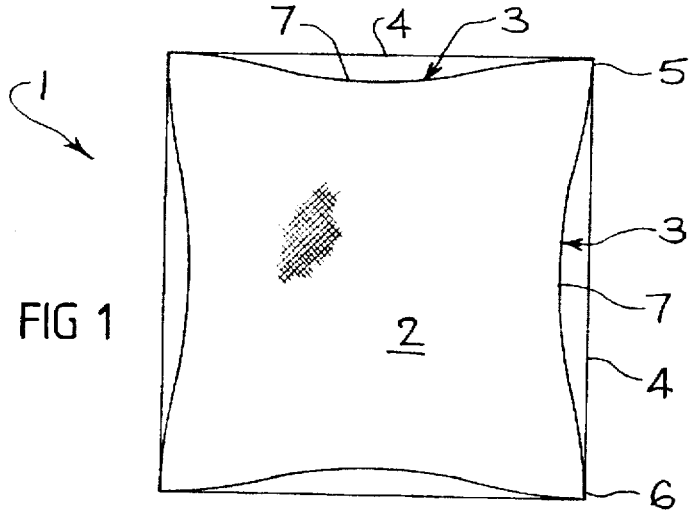
FIG. 1 is a plan view of a known canopy panel.
Figure 7:
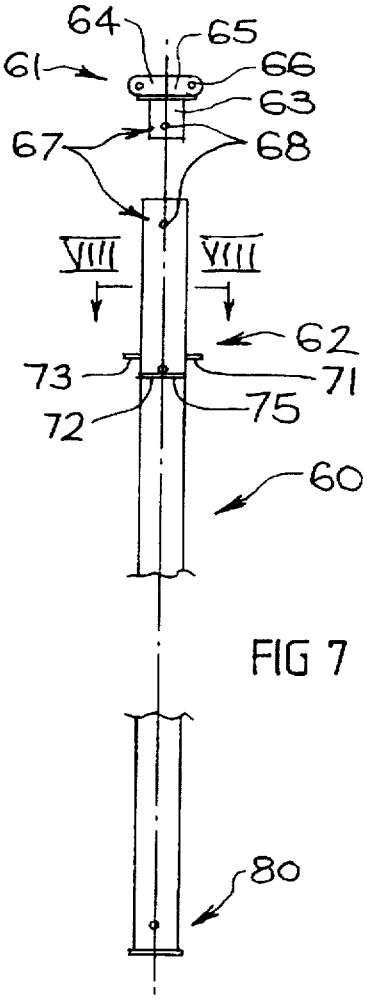
FIG. 7 is an exploded front view of one particular post of the canopy structure illustrated in FIGS. 5 and 6.
Figure 8:
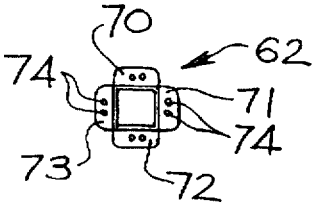
FIG. 8 is a sectional plan view through section VIII—VIII in FIG. 7.
Figure 9:
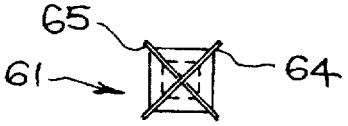
FIG. 9 is a top plan view of the post of FIG. 7.

The canopy structure utilizes five different types of support posts designated respectively by C1, C2, C3, C4 and C6 in FIG. 2. Each of these is described separately in more detail below:

The post C1 is illustrated in FIGS. 7 to 9. The post 60 is a hollow square cylindrical column which extends vertically from a support surface up to the canopy cover.

The post 60 includes a panel anchor 61 (indicated by numeral 33 in FIG. 2) at the upper end thereof and a cable attachment means 62 spaced beneath said panel anchor 61. The panel anchor 61 comprises a pair of intersecting cross-plates 64, 65 rigidly mounted on a downwardly projecting spigot 63. The two major surfaces of the cross-plates 64, 65 extend in a vertical direction. Each plate 64, 65 extends diagonally across the top of the post 60 through diagonally opposed corners of the post 60. The two plates 64, 65 therefore also project outwardly perpendicular to each other. Each end of each cross-plate 64, 65 has an aperture 66 for the passage of a shackle therethrough to anchor a panel 10. The orientation of the cross-plates 64, 65 is shown in FIG. 9. The spigot 63 is square cylindrical and is sized to be received within the open top of the post 60 with a small amount of clearance. The post 60 includes locking means 67 for locking a panel anchor 61 to the post 60. The locking means 67 comprises registering apertures 68 on each of the anchor 61 and post 60 through which a locking element (not shown) is passed to lock the anchor 61 to the post 60.

The cable attachment means comprises a plurality of laterally outwardly projecting plates, 70, 71, 72, 73 one positioned on each face of the post 60. Opposing plates 70, 72 and 71, 73 are vertically aligned with each other and adjacent plates are vertically staggered with respect to each other. Each plate 70, 71, 72, 73 has a pair apertures 74 defined therethrough, through which a said cable (not shown) may be passed to form a cleat. The cleats facilitate appropriate tensioning of the cables 53 between the posts 60. The precise configuration and position of the apertures 74 on each of the plates is shown in FIG. 8.

In addition a single aperture 75 is defined through the post 60, proximate to said plates 70 71, 72, 73. This enables a said cable to be passed through the post 60 without being positively attached thereto. Thus the post 60 can either have a said cable 53 passed therethrough without positive attachment or else a cable 53 can be attached to the post 60 by means of the cleats.

Figure 10:
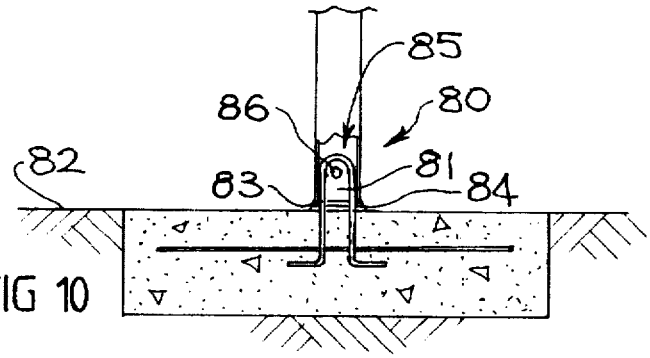
FIG. 10 is a front view of the lower end of the support post of FIG. 7.

FIG. 10 shows a lower end region 80 of the post 60. The post 60 is mounted on a base locating formation 81 which is anchored to the support surface 82. One particular base locating formation 81 is shown in FIG. 10 although it is to be appreciated that other assemblies could equally be used.

The open bottom 83 of the post 60 is mounted circumferentially over the formation 81. A resilient element 84 is disposed between the bottom 83 of the post 60 and the support surface 82 for facilitating some rocking of the post 60 on the support surface 82. The post 60 includes locking means 85 for locking the post 60 to the base formation 81. The locking means 85 comprises registering apertures 86 on each of the post 60 and base locating formation 81 through which a locking element (not shown) is passed to lock the post 60 to the formation 81.

FIGS. 11 to 19 show similar views of posts C2 to C6. The construction of these posts is substantially the same as that for C1. The base locating formation 83 of each of the posts 60 is the same as for C1 and is not described further.

The major difference in construction between the various posts lies with the cable attachment means 62 thereof. Posts C2, C3 and C6 are positioned on the periphery of the frame 50 and thus the cable attachment means 62 thereof is adapted for the attachment of the guys 57 thereto. Further while the row of C4 posts, is an internal row of the array, it has guys 59 attached to each of the posts 60 and thus is adapted accordingly. It is to be noted that none of posts C2 to C6 has an aperture or passage corresponding to the aperture 75 of the post C1. Thus each end of each strand of cable converging on posts C2 to C6 is positively attached thereto. The constructional features of the cable attachment means 62 of each of the posts C2 to C6 will be clearly understood from FIGS. 11 to 19 by a person skilled in the art and will not be described further. The panel anchors 61 of the posts C2, C4 and C6 are the same as the anchor 61 for post C1.

However the panel anchor 61 of post 3 is somewhat different. The panel anchor 61 of C3 has a rectangular horizonatally extending plate 64 mounted on a downwardly opening spigot 63. Part of the plate 64 projects outwardly beyond the edge of the post 60 and this part of the plate 64 has an aperture 66 therein for receiving a D-shackle which connects the inner ends 24, 25 of two strap portions 21, 22 making up a strap. As can be seen in FIG. 5, the posts C3 are positioned midway along each panel 10 around the periphery of the canopy structure.

Figure 20:
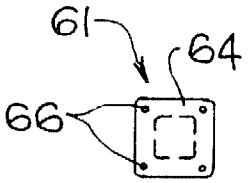
FIG. 20 is a top plan view of a support post which is a variation on the post of FIG. 7.
Figure 21:
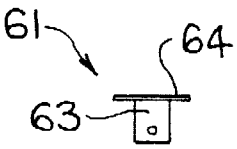
FIG. 21 is a front view of an upper end region of the support post of FIG. 19.
Figure 18:
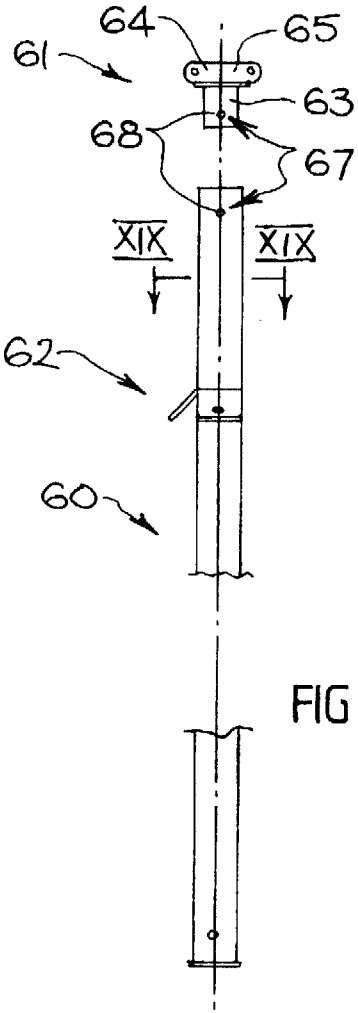
FIG. 18 is an exploded front view of another post of the canopy structure illustrated in FIGS. 5 and 6.
Figure 17:
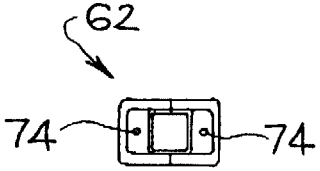
FIG. 17 is a sectional plan view through section XVII—XVII of FIG. 16.
Figure 16:
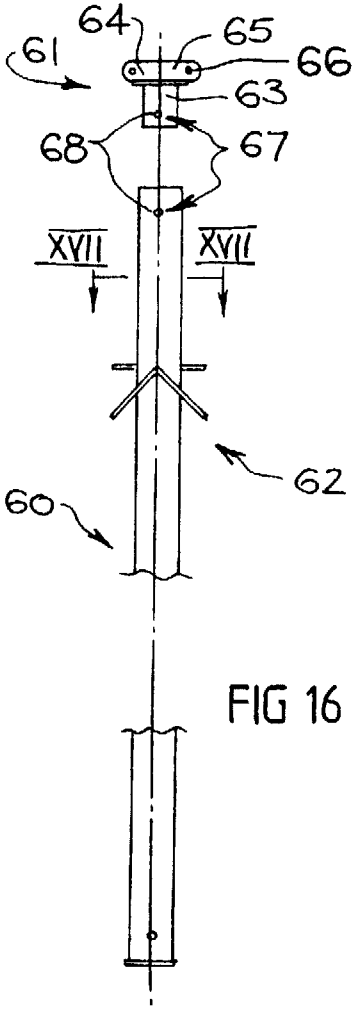
FIG. 16 is an exploded front view of another post of the canopy structure illustrated in FIGS. 5 and 6.

While the panel anchor assembly 61 of posts C1, C2, C3, C4 and C6 has been found to be particularly suitable, it is to be appreciated that other assemblies can also be used. An alternative panel anchor 61 is shown in FIGS. 20 and 21. This anchor comprises a rectangular horizontally extending plate 64 mounted on a spigot 63 which is as described above. Apertures 66 are formed in each of the corners of the plate 64 through which the D-shackles connecting the panels to the anchor are passed.

An advantage of a canopy structure erected in accordance with the invention is that it is simple and easy to erect and is generally stronger than known canopy structures. Further it enables each panel of the canopy to cover a larger area than was previously possible whilst retaining sagging deflection of each panel within acceptable limits. This reduces the number of support posts that are required for a given area which amongst other things reduces the construction costs of such a canopy. Further by providing greater areas of internal space free of posts, the canopy is rendered suitable for a wider variety of uses.

Put another way, by providing for points of attachment or loading of the panel intermediate the ends thereof, the tension in the support straps can be substantially reduced for a given span or distance between adjacent support posts. The relationship between the span length and strap tension is not linear. On the contrary strap tension increases exponentially with increase in span length. Thus by halving the span length, as is effectively achieved by this invention, the tension in the straps will be reduced to a quarter of what it otherwise would have been.

A further advantage of a canopy structure in accordance with the invention, is that the network of cables which interconnect the support posts is entirely separate from the cover of the structure. This prevents the build-up of post deflection when the structure is buffeted by wind. As a result the structure is capable of resisting high wind loads. Further the canopy cover is less susceptible to failure due to whiplash caused by wind. This is a particularly acute problem with known canopy structures.

A further advantage of a canopy structure in accordance with a preferred form of this invention is that the webbing loops within which the connection rings are received are stronger than known webbing loops. As the webbings are a major load-bearing component, and the webbing loop is invariably the weakest part of the webbing, this increase in strength is important.

Further, the ability of a canopy structure in accordance with this invention to withstand dead and line loads as well as wind loads is considerably enhanced.

Another advantage of a canopy structure in accordance with this invention is that it enables canopy covers having flatter profiles to be erected.

It is to be understood that various alterations, modifications, and/or additions may be introduced into the constructions and arrangements of parts previously described without departing from the spirit or ambit of the invention disclosed herein.

What is claimed is:

1. A canopy panel for mounting on a plurality of support posts, including:

a sheet of flexible material having sides;

a plurality of substantially inextensible support straps fixed to the sheet, one of said straps extending substantially along each of the sides of the sheet, each of said straps having means at each of the ends thereof for mounting the panel to a support post, and also means intermediate the strap ends for attaching at least one intermediate point on the support strap to an intermediate point on an adjacent support strap of an adjacent panel wherein each of the support straps defines a catenary configuration between one end thereof and the intermediate point, and a further catenary configuration between the intermediate point and the other end of the strap, and the ends of each of the catenary configurations are substantially adjacent the edge of the sheet and the remainder of the catenary configuration is positioned inwardly of the edge of the sheet.

2. A canopy panel according to claim 1, wherein said means intermediate the strap ends has only one said intermediate point on the strap for attachment thereof to an intermediate point on the adjacent support strap.

3. A canopy panel according to claim 2, wherein each of said support straps includes two strap elements arranged substantially end to end, and wherein said intermediate point of attachment on the strap is positioned in between said strap elements.

4. A canopy panel according to claim 3, wherein said means for attaching said intermediate point on said strap to the adjacent strap includes two attachment elements, one on each of the two strap elements, said attachment elements facilitating coupling of the strap elements to each other as well as attachment to the adjacent support strap.

5. A canopy panel according to claim 4, wherein said means for mounting the panel to the support posts comprises further attachment elements at each end of the support strap.

6. A canopy panel according to claim 5, wherein said attachment elements each comprise a loop of strap material.

7. A canopy panel according to claim 6, wherein each loop of strap material includes a short length of bent rope for shaping each loop, and the rope is enclosed in a sheath of material of low frictional resistance for reducing wear of each loop due to a connecting ring which happens to be passed therethrough.

8. A canopy panel according to claim 1, wherein the canopy panel has a substantially rectangular configuration for mounting on four support posts, and each of the straps is formed of webbing material and said sheet is formed of knitted stretch fabric.

9. A canopy structure including:

a plurality of support posts arranged substantially in the form of an array;

a plurality of panels mounted on the support posts to form a canopy cover, each of said panels comprising a sheet of flexible material having sides and a plurality of substantially inextensible support straps fixed to the sheet, one of said straps extending substantially along each of said sides of the sheet with each end of each said strap being mounted onto a post, and at least one of the support straps of each of the panels having at least one point intermediate the ends thereof at which the strap is attached to an intermediate point on the strap of an adjacent panel.

10. A canopy structure according to claim 9, wherein each of the support straps of each panel defines catenary configurations between one end of the support strap and the intermediate point, and further catenary configurations between the intermediate point and the other end of the strap, and wherein the ends of each of the catenary configurations are substantially adjacent the edge of the sheet and the remainder thereof is positioned inward of the edge of the sheet.

11. A canopy structure according to claim 9, wherein said at least one of the support straps has only one point intermediate the ends thereof at which the strap is attached to the strap of an adjacent panel, said point being located substantially midway along the length thereof.

12. A canopy structure according to claim 11, wherein said at least one of the support straps comprises two strap elements arranged substantially end-to-end, and said intermediate point of attachment to an adjacent strap is located between said strap elements.

13. A canopy structure according to claim 12, including at least two attachment elements at said intermediate point of attachment on said support straps, one on each of the support strap elements, the attachment elements facilitating attachment of the support straps to the straps of an adjacent panel and also facilitating coupling of the two strap elements to each other.

14. A canopy structure according to claim 13, including further attachment elements at each of the ends of each of the support straps facilitating attachment of the support straps to the support posts.

15. A canopy structure according to claim 14, wherein said attachment elements each comprise a loop of strap material.

16. A canopy structure according to claim 15, wherein each of the panels has a substantially rectangular configuration and is mounted on four support posts, and all panels except those forming part of a peripheral edge of the canopy structure have intermediate points of attachment on all four of the straps thereof.

17. A canopy structure according to claim 16, including connecting rings passed through the loops at each of the ends of each of the straps and passed through anchors on the support posts, to anchor each of the ends of each of the support straps to the support posts and further connecting rings attaching the loops of each of the intermediate points of attachment on the support straps to the intermediate point of attachment on adjacent support straps.

18. A canopy structure according to claim 9, wherein contiguous edges of adjacent panels are attached to each other along substantially the entire length thereof so that the canopy cover is continuous, and the support straps are mounted on an underside of the sheet of flexible material so that the sheet is positioned between the support strap and ultraviolet radiation produced by the sun.

19. A canopy structure according to claim 9, including canopy support means, comprising a network of flexible elongate elements under tensile loading, linking substantially all the support posts together, supporting said support posts independently of the panels, and also tensioning the canopy structure including the panels.

* * * * *